US005454173A

United States Patent [19]

Falguere et al.

[11] Patent Number: 5,454,173

[45] Date of Patent: Oct. 3, 1995

[54] SPORTS BOOT WITH A JOURNALLED COLLAR

[75] Inventors: Jean-Luc Falguere, Annecy; Didier Rousset, Aix les Bains, both of France

[73] Assignee: Salomon S.A., Annecy Cedex, France

[21] Appl. No.: 131,577

[22] Filed: Oct. 4, 1993

Related U.S. Application Data

[63] Continuation of Ser. No. 747,392, Aug. 20, 1991, abandoned.

[30] Foreign Application Priority Data

Aug. 22, 1990 [FR] France ..... 90 10695

[51] Int. Cl.[6] ..... A43B 5/04

[52] U.S. Cl. ..... 36/117; 36/120

[58] Field of Search ..... 36/117, 118, 119, 36/120, 121, 89, 114, 115

[56] References Cited

U.S. PATENT DOCUMENTS

| | | | |
|---|---|---|---|
| 2,972,822 | 2/1961 | Tanner | 36/89 |
| 3,303,584 | 2/1967 | Werner et al. | 36/120 |
| 3,410,006 | 11/1968 | Vogel | 36/119 X |
| 3,885,329 | 1/1975 | French | 36/120 |
| 4,152,849 | 5/1979 | Frechin et al. | 36/120 |
| 4,334,368 | 6/1982 | Chalmers, II et al. | 36/121 |
| 4,539,764 | 9/1985 | Pradier | 36/121 |
| 4,601,118 | 7/1986 | Zanatta | 36/121 X |
| 4,615,128 | 10/1986 | Borsoi | 36/120 |
| 4,622,765 | 11/1986 | Baratto et al. | 36/120 |
| 4,839,972 | 6/1989 | Pack et al. | 36/117 |
| 5,033,210 | 7/1991 | Dodge et al. | 36/121 |
| 5,046,269 | 9/1991 | Pozzobon | 36/120 |
| 5,068,984 | 12/1991 | Kaufman et al. | 36/117 |
| 5,142,798 | 9/1992 | Kaufman et al. | 36/117 |
| 5,177,884 | 1/1993 | Rullier | 36/117 |

FOREIGN PATENT DOCUMENTS

| | | | |
|---|---|---|---|
| 0174000 | 3/1986 | European Pat. Off. . | |
| 0356400 | 2/1990 | European Pat. Off. . | |
| 2433311 | 4/1980 | France | 36/121 |
| 2535793 | 2/1977 | Germany | 36/121 |
| 3919430 | 12/1989 | Germany . | |

OTHER PUBLICATIONS

French Search Report and Annex.

*Primary Examiner*—Steven N. Meyers
*Assistant Examiner*—BethAnne C. Cicconi
*Attorney, Agent, or Firm*—Sandler, Greenblum & Bernstein

[57] ABSTRACT

A sports boot, especially for cross-country skiing or walking, including an upper, a reinforcement extending at least vertically upwardly on each side of the heel, and a rigid collar encircling at least the ankle, and connected by its sides to the reinforcement, by two anchoring systems located on each corresponding side of the foot, and enabling the rotation of the collar along a substantially transverse axis with respect to the upper of the boot. At least one of the anchoring systems is effective for varying the position of the corresponding side of the collar with respect to the reinforcement, for enabling the inclination of the collar with respect to the median vertical plane of the boot and/or the rotation of the collar around a substantially vertical axis.

19 Claims, 7 Drawing Sheets

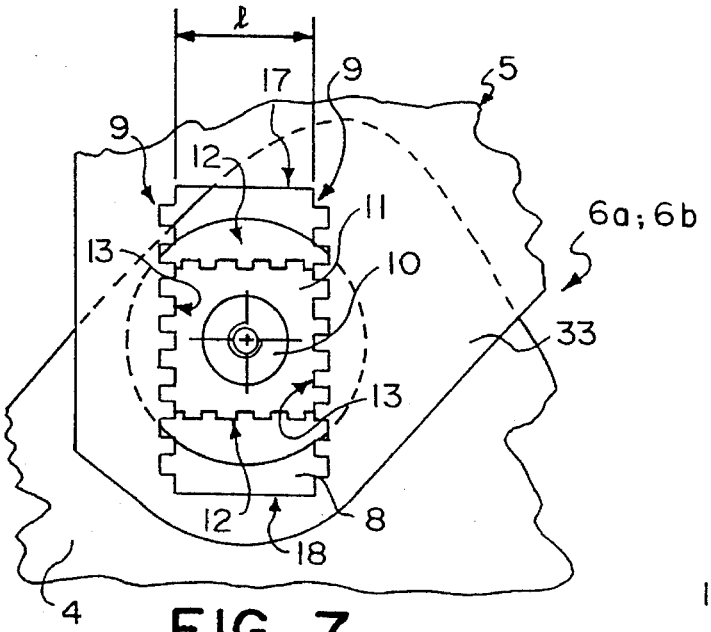
FIG. 7
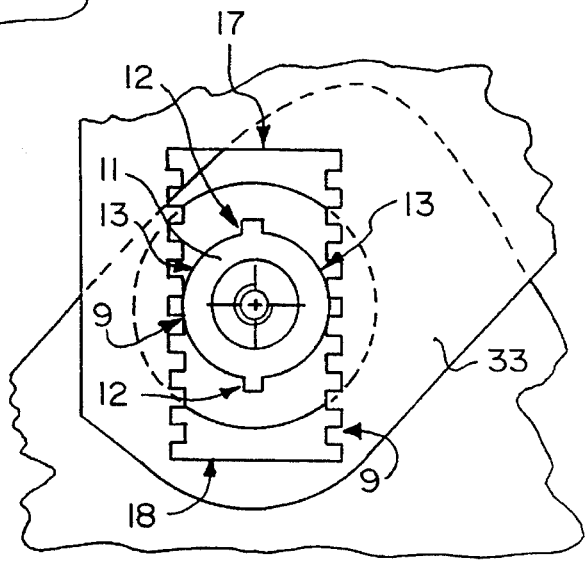
FIG. 8
FIG. 9
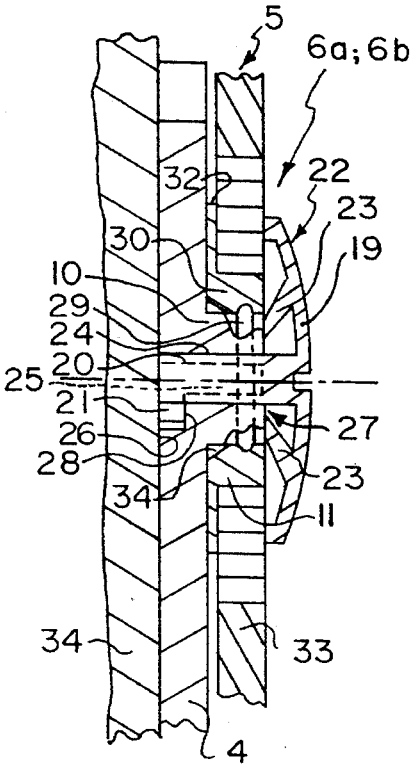
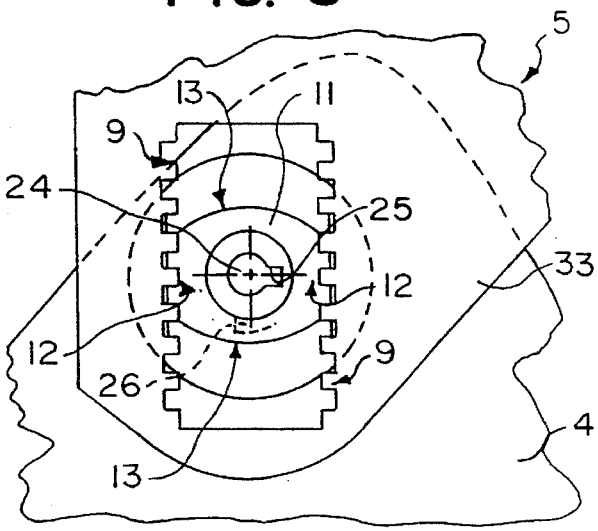
FIG. 10

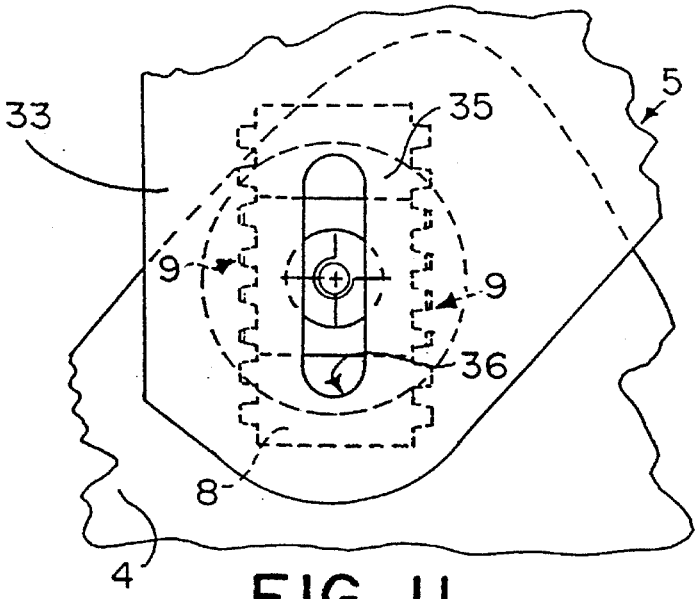
FIG. 11
FIG. 12
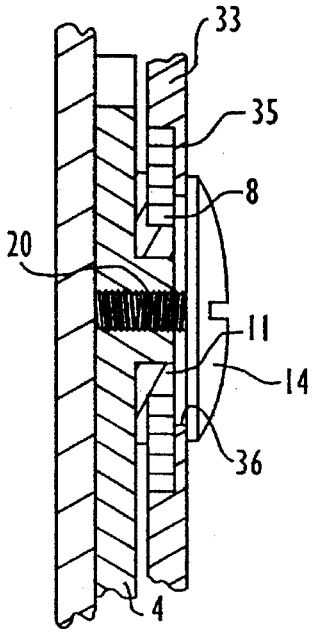
FIG. 13
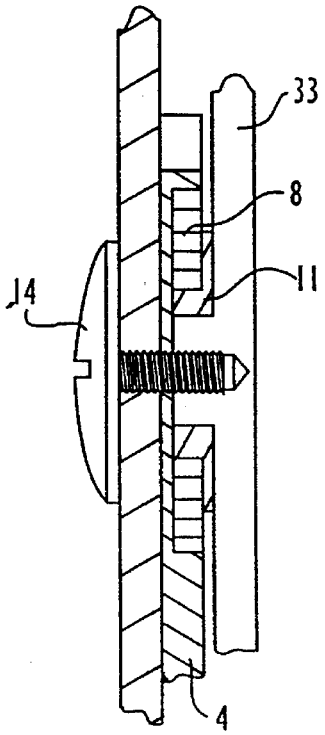

SPORTS BOOT WITH A JOURNALLED COLLAR

This application is a continuation of application Ser. No. 07/747,692, filed Aug. 20, 1991, now abandoned.

BACKGROUND OF THE INVENTION

1. Field of the Invention

The present invention is related to a sports boot comprising a sole, an upper mounted on the sole, a rigid reinforcement reinforcing the upper in the heel area, and a rigid collar encircling the ankle, and journalled on the reinforcement about a substantially transverse journal axis with respect to the longitudinal axis of the boot.

2. Description of Background and Relevant Information

A boot of the above-mentioned type is described in French application FR 89.11936, commonly assigned with the present application. The journalled collar has the advantage, by virtue of being made of a rigid material, of increasing the lateral rigidity of the upper, and thus of maintaining the tibia in a transverse direction, and also enabling the leg to rotate about a transverse axis with respect to the longitudinal axis of the boot. This boot is thus advantageous for hiking or, in the case of a cross-country ski boots, during skiing, and especially in a sliding motion.

However, such boots have a transverse rigidity that do not enable the boots to adapted be to the morphology of the user. This is especially disadvantageous for users with clubbed or cleft feet. In the case of these users, the axis of the tibia is inclined either towards the inside of the foot or towards the outside of the foot, with respect to the median vertical plane of the foot. When they use a boot with a rigid collar of the type described above, they close the collar around their tibia by virtue of a closing system of the collar. Consequently, the axis of the tibia coincides with the axis of the rigid collar. In the case of club or cleft-footed users, the sole of the boot, and consequently, the sole of the ski in the case of cross-country skiing, which are perpendicular to the axis of the collar, are no longer parallel to the ground, and thus, no longer in contact with it, but are inclined with respect to it. Moreover, the sole of the foot of the user is not in uniform contact with the internal sole of the boot. The distribution of pressure on the sole of the foot is thus not natural, and this impairs the comfort of the user, as well as the control of the boot or the ski.

SUMMARY OF THE INVENTION

An object of the present invention is to overcome the foregoing disadvantages by proposing a sports boot, especially for walking or cross-country skiing, that is able to adapt to the morphology of the user and especially for users with clubbed or cleft feet.

Another object of the invention is to provide a boot of the above-mentioned type, with a collar that is normally laterally rigid, to be laterally flexible so as to enable the pivoting of the leg with respect to the upper, in a substantially longitudinal direction. This flexibility of the collar may be desirable during sliding motions where lateral rigidity is necessary in order to engender support of the tibia on the boot, only on the internal side of the foot in order to accentuate an internal right angular stop, the external side of the collar being able to remain flexible.

These objects are achieved by the invention, which comprises a sports boot constituted of an upper, of a reinforcement extending at least vertically upwardly on each side of the heel, and of a rigid collar encircling at least the ankle, and connected by its internal and external sides, located respectively on the internal and external sides of the foot, to the reinforcement by two internal and external anchoring systems, located on each corresponding side of the foot, and enabling the rotation of the collar about a substantially transverse axis with respect to the longitudinal axis of the boot. The boot according to the invention is characterized by the fact that at least one of the anchoring systems comprises means for varying the relative position of the corresponding side of the collar, with respect to the reinforcement.

Due to this fact, the axis of the rigid collar may be inclined with respect to the median vertical plane of the upper, at an angle corresponding substantially to the inclination of the axis of the tibia of the user with respect to a right angle, or any other angle enabling improvement of skiing, by enabling, for example, the skier to accentuate an angular stop by inclining the plane of the ski with respect to the snow, by deliberate inclination of his foot with respect to the tibia.

Advantageously, anchoring systems enable each side of the collar to be anchored on the reinforcement in a removable or non-removable and adjustable manner, at diverse positions distributed on a segment substantially parallel to the axis of the rigid collar, on the one hand on the internal side, and on other hand, on the external side of the collar. According to a preferred embodiment, the variation means comprise, on each of the internal or external sides of the collar, an oblong groove, oriented along a direction substantially parallel to the axis of the collar, provided with at least one indentation on each of its vertical surfaces, and cooperating with a ring equipped with two diametrically opposed serrated surfaces, and pivotally mounted on an axis that is substantially transverse and affixed to the reinforcement. One can thus place the indentations of the collar in accordance with several positions on the serrated surface of the ring. The anchoring system is advantageously latched by means for transversely maintaining the side on the reinforcement, comprising a maintenance screw that transversely maintains the side of the rigid collar on the serrated ring by a transverse abutment, this screw being screwed in the reinforcement.

By virtue of these two anchoring systems, the collar can be anchored on both of its sides at a same vertical position, the collar thus defining a vertical axis. This advantageously enables the total height of the collar to be adjusted, by choosing the vertical position for anchoring the same, and thus enabling the user to choose the height of the boot. One can also anchor the collar at two different vertical positions for the external side and for the internal side of the collar. The axis of the collar is thus inclined at a desired angle with respect to the median vertical plane of the boot, corresponding to the morphology of the user.

Moreover, the ring being pivotally mounted on an axis affixed to the reinforcement, the collar retains the possibility for rotation about an axis transverse to the longitudinal axis of the boot, and this enables front and rear flexion of the leg with respect to the foot.

Also, according to another aspect of the invention, the anchoring system comprises disengagement means so as to enable movement in the vertical direction of the sides of the collar, and thus in a transverse direction to the leg of the user.

According to a preferred embodiment, the ring comprises two smooth surfaces, and one can make the ring pivot a quarter of a circle around the transverse axis affixed to the reinforcement such that the smooth surfaces are in sliding contact with the indentations. Thus, the indentations slide on the smooth surfaces. The side of the collar is therefore free in translation in a direction substantially parallel to the axis of the collar, and enables an angular movement of the collar in a plane transverse to the longitudinal axis of the boot.

BRIEF DESCRIPTION OF THE DRAWINGS

The invention will be better understood and its other characteristics will become apparent from the description that follows, with reference to the annexed schematic drawings, representing non-limiting preferred embodiments, in which:

FIG. 7 is a profile section of a detail of the invention in a sliding position;

FIG. 8 is a profile view of a detail of a second embodiment of the invention;

FIG. 9 is a partial sectional view of a second embodiment of the invention;

FIG. 10 is a profile view of a detail of a third embodiment;

FIG. 11 is a profile view of a detail of a fourth embodiment;

FIG. 12 is a partial sectional view of FIG. 11; and

FIG. 13 is a partial sectional view of a further embodiment.

DETAILED DESCRIPTION OF THE PREFERRED EMBODIMENTS

Figure 1:
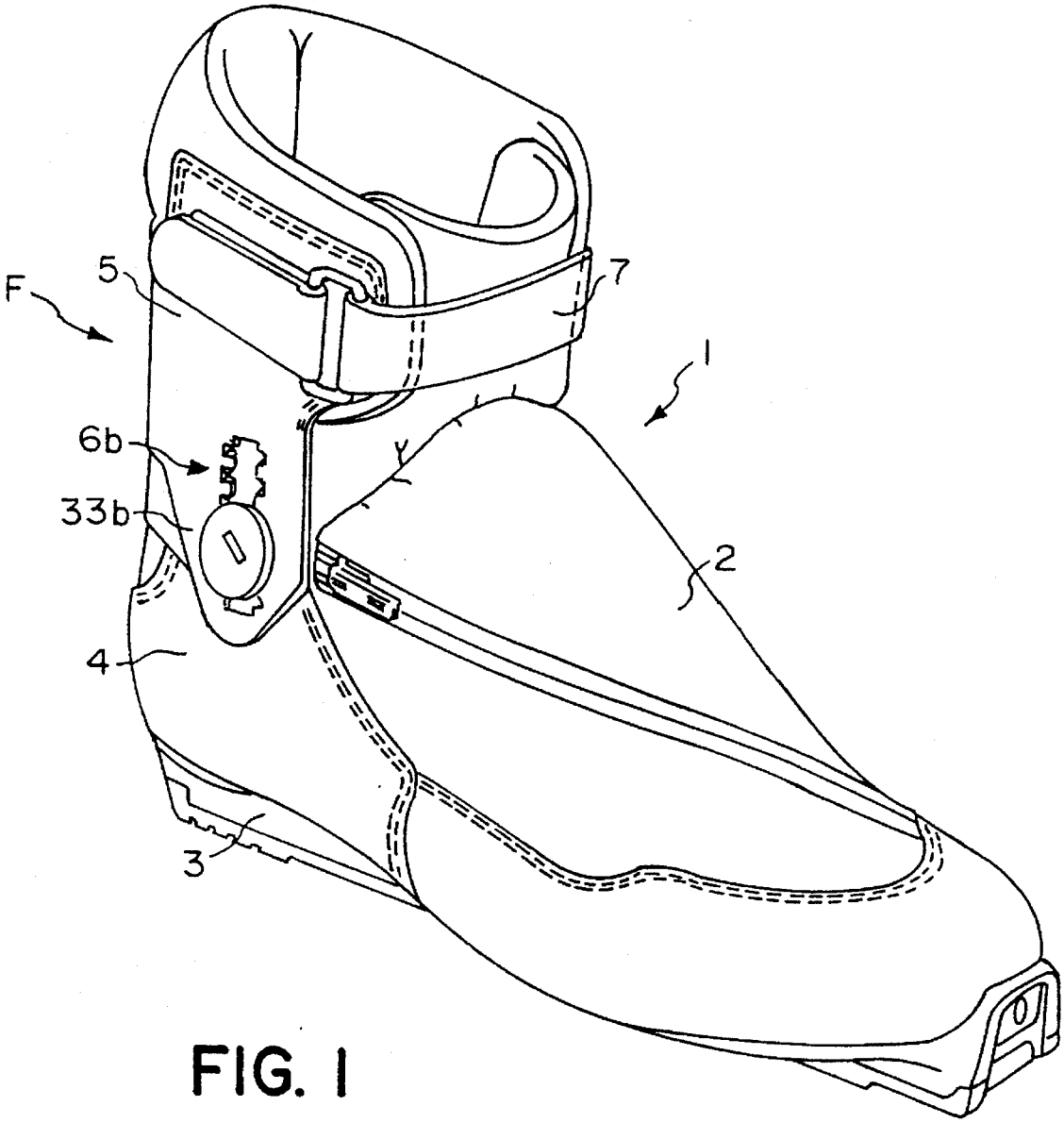
FIG. 1 is a perspective view of the boot according to the invention.

FIG. 1 represents a cross-country ski boot 1 constituted by an upper 2 covering the top of the foot, and mounted on a sole 3. The upper 2 is reinforced in the heel zone by a reinforcement 4. This reinforcement 4 extends vertically upwardly until the zone of the malleoli in order to advantageously protect them. A rigid collar 5 extends the upper 2 upwardly in order to encircle the ankle and maintain it transversely.

Figure 2:
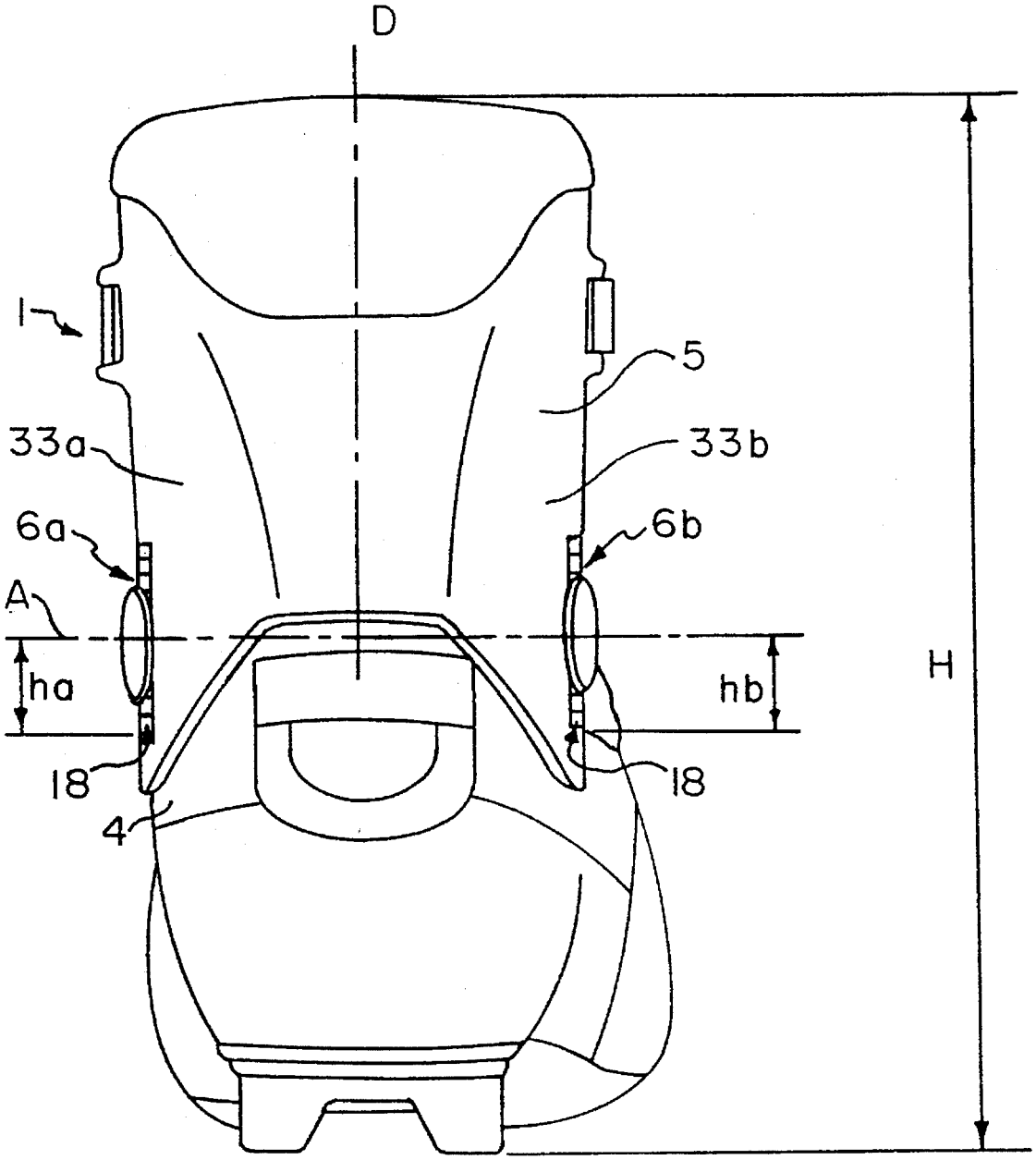
FIG. 2 is a view of the boot in the direction of arrow F in FIG. 1, according to the invention.

The external side 33*a* and internal side 33*b* of collar 5 are connected to reinforcement 4 by an anchoring system 6*b*, on the external side of the foot, and an anchoring system 6*a* on the internal side of the foot, as represented in FIG. 2. These two anchoring systems 6*a*, 6*b* enable the rotation of collar 5 about a substantially transverse axis which is transverse to the longitudinal axis of boot 1, so as to follow the tibia of the skier in flexion during skiing. The collar 4 is affixed to the tibia of the skier by tightening means 7 of collar 5 that may be constituted, for example, by a buckle/strap system as represented in the drawings.

Moreover, the two anchoring systems 6*a*, 6*b* comprise means for varying the position of side 33*a*, 33*b*.

Figure 3:
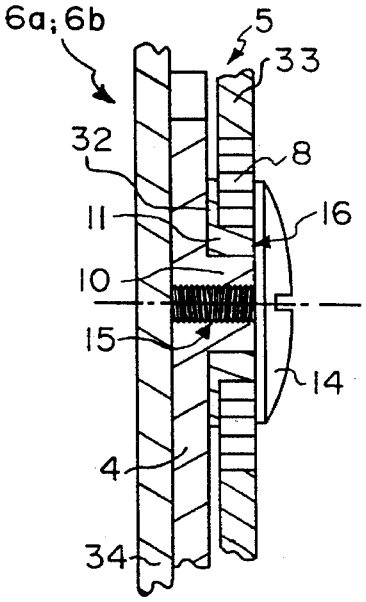
FIG. 3 is a partial transverse sectional view of a first embodiment of the invention.
Figure 4:
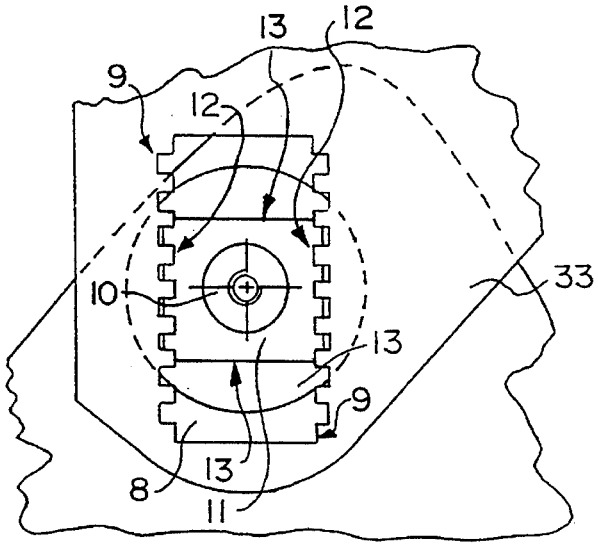
FIG. 4 is a detailed side view of FIG. 3.

FIG. 3 represents the construction of the variation means. The side 33 of collar 5 includes an oblong groove 8 extending substantially along the axis of collar 5, i.e., vertically, as in FIG. 3, and is equipped on its vertical surfaces with indentations 9 represented in FIG. 4. The reinforcement 4 comprises a projection forming a substantially transverse axis 10 on reinforcement 4 on which the ring 11 is mounted freely in rotation. This ring 11, of a substantially square shape, includes, as is represented in FIG. 4, two opposing and serrated surfaces 12, and two opposing and smooth surfaces 13. The teeth of the serrated surfaces 12 may engage the indentations 9 of groove 8, whereas the distance between the smooth surfaces 13 is such that ring 11 slides freely, and at the same time is guided in translation in groove 8. The means for transversely maintaining side 33 of collar 5 on reinforcement 4 include a maintenance screw 14, represented in FIG. 3, that is screwed on reinforcement 4 which comprises a thread 15 that may include a threaded insert of a material more resistant than that of reinforcement 4 (not shown), in order to reduce wear and tear of reinforcement 4. The head of the maintenance screw 14 constitutes an abutment 16, which prevents side 33 of collar 5 from disengaging transversely from reinforcement 4 (towards the right in FIG. 3). The lining 34 protects the foot with respect to reinforcement 4.

In order to adjust collar 5, vertically or angularly, the maintenance screw 14 is unscrewed with help of a screwdriver in the example represented. This screw 14 may also comprise a knurl on its periphery (not shown), so as to be able to be unscrewed without a tool. When the maintenance screw 14 is separated from reinforcement 4, one can pull side 33 of collar 5 towards the right such that indentations 9 are no longer meshed with the serrated surfaces 12 of ring 11. One can thus displace side 33 of collar 5 vertically, and make it mesh with the serrated surfaces 12 of ring 11 at a higher or lower position, by varying the distance ha, hb between the rotational axis A of the collar and the lower surface 18 of the groove (FIG. 2). The maintenance screw 14 is then retightened so as to maintain collar 5 on reinforcement 4 in a transverse direction. It should be noted that this embodiment advantageously includes a collar 5 that may be disengaged from the reinforcement 4, and is thus, removable so as to transform a boot 1 with a high upper into a boot with a low upper. A maintenance screw 14, (not shown), whose path is greater than the thickness of collar 5, may also be provided in order to enable the meshing of indentations 9 on the serrated surfaces 12 without disengaging the screw 14 from reinforcement 4. The maintenance screw 14 thus constitutes a disengagement means of the anchoring system 6*a*, 6*b*.

These anchoring systems 6*a*, 6*b* consequently enable sides 33*a*, 33*b* (FIG. 2) of collar 5 to be fixed on reinforcement 4 in a vertical direction, by choosing distances ha, hb according to a discrete variation of the same. One can thus advantageously anchor sides 33*a*, 33*b* of collar 5 so as to have distances ha, hb that are equal (FIG. 2). The axis D of collar 5 is thus vertical. One can vary this distance ha, hb in a given interval so as to vary height H of boot 1. The user can thus choose this height H if it is desired to have a transverse maintenance of the tibia at a greater height H or at a smaller height H.

Figure 5:
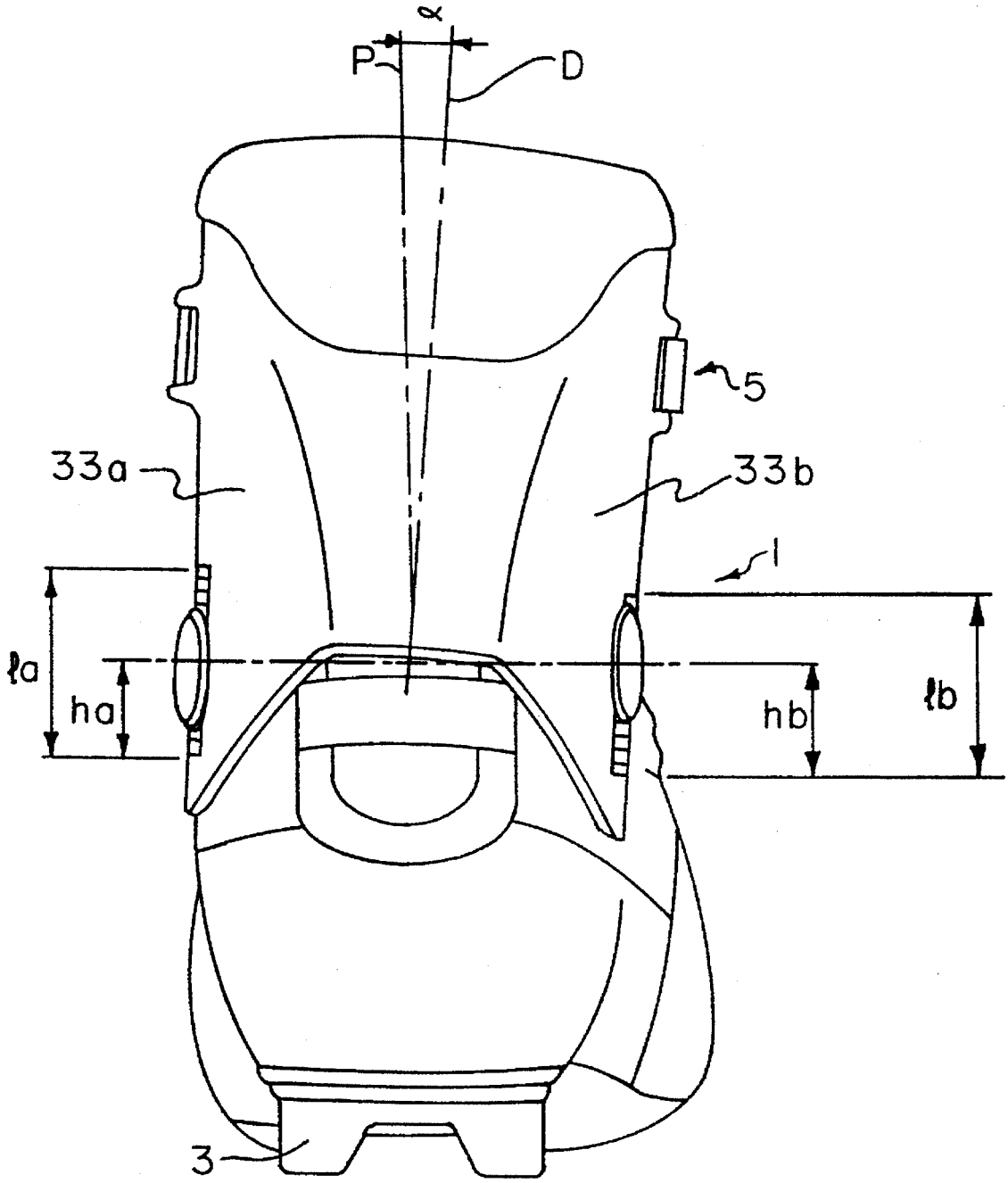
FIG. 5 is a view of the invention in the direction of arrow F, in an initial position.

As is represented in FIG. 5, the sides 33*a*, 33*b* of collar 5 may be anchored such that hb>ha, thus inclining the axis D of collar 5 at angle $\alpha$, towards the external side of the foot, with respect to the median vertical plane P of boot 1. The user may thus advantageously incline collar 5 by an angle $\alpha$ corresponding to the inclination of his or her tibia due to clubbed feet, with respect to the right angle. Comfort is thus advantageously increased, especially in the case of walking boots for which one can also use these anchoring systems for the collar. The foot is in natural contact with the internal sole of boot 1. The external sole 3 is thus in uniform contact with the ground, and this enables the foot from becoming stiff in boot 1, and advantageously improves efficiency while walking. On the other hand, in the case of a cross-country ski boot, as represented in FIG. 1, the sole of the ski (not shown) is in uniform contact with the ground, and this improves sliding while skiing.

Figure 6:
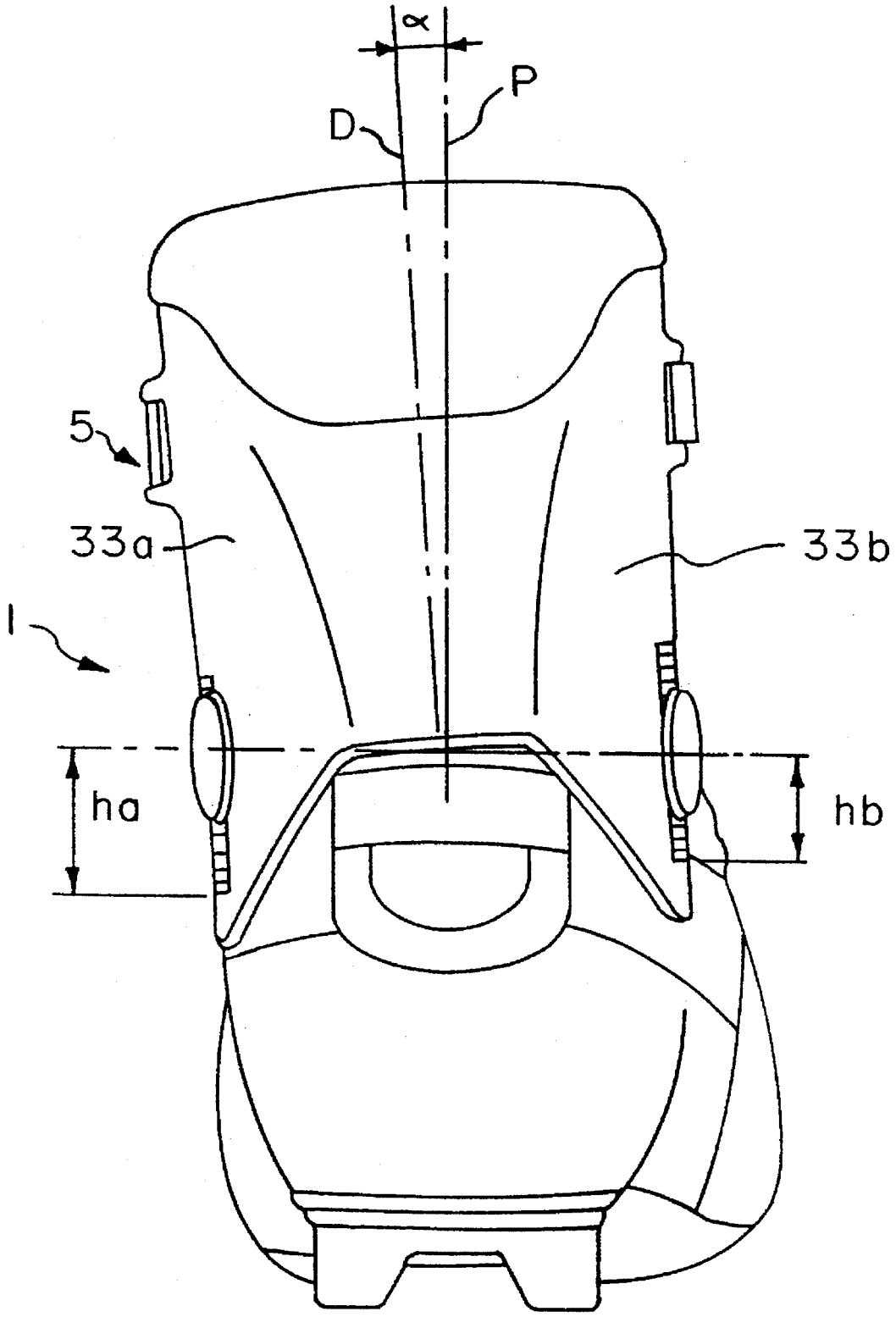
FIG. 6 is a view of the invention in the direction of arrow F, in a second position.

In the embodiment represented in FIG. 6, sides 33*a*, 33*b* of collar 5 are anchored such that hb<ha, and this has the advantage of inclining axis D of collar 5 at an angle α towards the internal side of the foot with respect to the median vertical plane P of boot 1. This configuration is advantageous for users with cleft feet, the collar 5 adapting, by virtue of a device according to the invention, to the user's morphology. The advantages that are gained by such an adaptation are identical to those that are procured from a configuration such as the one represented in FIG. 5.

FIG. 7 represents an anchoring system 6*a*, 6*b* without maintenance screw 14, in order to facilitate understanding. The disengaged position of the discrete variation means of the anchoring system 6*a*, 6*b* are obtained by removing the maintenance screw 14 by unscrewing, and by pulling out side 33 of collar 5 so as to eliminate meshing of indentations 9 with the serrated surfaces 12 of ring 11. One can also unscrew screw 14 whose path is at least equal to the thickness of collar 5, so as to be able to remove side 33 of the collar from ring 11 without disengaging screw 14 from side 33. One can then pivot ring 11 a quarter of a rotation about its axis 10. The serrated surfaces 12 are then perpendicular to the surfaces of the oblong groove 8 comprising indentations 9.

Side 33 of collar 5 is then repositioned in place against reinforcement 4. The smooth surfaces 13 of ring 11 come into contact with the indentations 9. Maintenance screw 14 is retightened so as to maintain collar 5 on reinforcement 4 in a transverse direction.

Side 33 of collar 5 is thus free for vertical movement, the indentations 9 sliding on the smooth surfaces 13 of ring 11 serving to constitute means for continuous variation of the position of the side 33 on reinforcement 4, between two limits fixed by the upper surface 17 and lower surface 18 of the oblong groove 8. The distance between the smooth surfaces 13 should permit sliding of ring 11 in an oblong groove 8 with an internal width l. This disengagement has the advantage of allowing the user to either reduce the transverse rigidity of boot 1, on the external side of the foot, or on the internal side of the foot, or on both sides simultaneously. One thus obtains a certain flexibility of collar 5 that may be advantageous during sliding motions, where transverse maintenance ensuring support of the leg is necessary mainly on the internal side of the leg, the external side not requiring support, and being able to remain flexible transversely. During such a step, one can thus disengage the discrete variation means of the external anchoring system 6*b*, and use its continuous variation means, by keeping the discrete variation means of the internal anchoring system 6*a* meshed, so as to ensure internal support and external flexibility. This enables the skier to accentuate, for example, an internal right angular stop, by inclining the plane of the sole with respect to the plane of the snow. This inclination, transmitted by deliberate inclination of the median vertical plane of the foot with respect to the median vertical plane of the tibia, enables forces that are vertical to the internal right angle to be transmitted without "pulling in the knee".

One can also place the two anchoring systems 6*a*, 6*b* in a position of free variation of the position of side 33*a*, 33*b* so as to have a boot 1 with reduced transverse rigidity.

FIG. 8 represents a second embodiment of the invention, wherein the ring 11 comprises a smooth external cylindrical surface 13. This serrated surface 12 comprises a single tooth. In the position of continuous variation of the position of side 33, such a configuration allows less rubbing, and thus less wear and tear between the indentations 9 and the smooth surfaces 13 of ring 11, due to the fact that there is one less contact surface between ring 11 and indentations 9. In a non-represented manner, surfaces 17, 18 of the oblong groove may be constituted by cylindrical portions such that they take the shape of the ring 11.

A ring 11 of the type represented in FIG. 10 may also be provided, that is, a ring having serrated surfaces 12 comprising several teeth, so as to facilitate positioning of side 33 of collar 5 on ring 11 when the position is changed, and also to have better resistance to breaking of ring 11 due to the presence of the considerable number of teeth engaged with indentations 9. Ring 11 also has two smooth surfaces 13 having a greater radius of curvature than the internal semi-width l of the groove so as to reduce the sliding surface of ring 11 on indentations 9 and to limit its wear and tear and to reduce the rubbing forces between ring 11 and collar 5.

FIGS. 9 and 11 also represent an embodiment for replacing the maintenance screw 14 of the first embodiment by a maintenance spoiler 19, (not shown in FIG. 10), also constituting the maintenance means of side 33 on reinforcement 4, and the disengagement means of anchoring system 6*a*, 6*b*. This maintenance spoiler 19 is constituted by a cylindrical body 20 provided at its ends with a lug 21, a plate 22 and elastic hooks 23. The reinforcement 4 comprises an orifice 24 (FIG. 10) provided with a longitudinal groove 25 extending along the entire height of the orifice, and a clearance 26 in the shape of a quarter of circle and with a height less than that of opening 24. To maintain side 33 of collar 5 on the reinforcement 4, a cylindrical body 20 of the maintenance spoiler 19 is introduced in opening 24 of reinforcement 4, in such a way that lug 21 coincides with the longitudinal groove 25. The cylindrical body 20 is then pushed back in opening 24 until the elastic hooks 23 come into contact with axis 10 of the reinforcement. Plate 22 is then pressed so as to push back body 20 until lug 21 coincides with clearance 26, and while doing this, elastic hook 23 is compressed against the transverse surface of axis 10. The maintenance spoiler 19 is then turned a quarter of a rotation such that lug 21 engages in clearance 26. Then, the maintenance spoiler 19 is released. The elasticity of the elastic hooks 23 which is due to their material and to their shape, biases the cylindrical body 20 such that lug 21 is pressed towards the right against the transverse surface 28 of the clearance 26. In this way, the maintenance spoiler 19 is retained transversely in a stable position in its orifice 24, and side 33 of collar 5 is thus maintained in a transverse direction on reinforcement 4, with the possibility of rotation about axis 10. Moreover, during rotation of side 33 of collar 5 about axis 10, the elastic hooks 23 are in contact with the transverse surface 27 which is fixed, and thus there is no wear and tear of hooks 23 during rotation. This second embodiment has a simple adjustment of the position of collar 5.

Another advantage of this second embodiment represented in FIG. 9 is constituted by the transverse retention means of ring 11 on reinforcement 4. The reinforcement 4 is affixed to axis 10 acting as the rotational axis for ring 11. This axis 10 comprises, on its external cylindrical surface, a projecting ring 29 that cooperates with a neck 30 provided inside ring 11. Ring 11 also comprises an internal chamfer 31. In order to position the ring 11 on reinforcement 4, it is pressed in such a way that the projecting ring 29 is positioned in neck 30 by elastic deformation of ring 11. The chamfer 31 acts as an engagement ramp for the projecting ring 29. This construction advantageously engages transverse maintenance of ring 11 on reinforcement 4, especially during adjustment manipulations of collar 5, and this prevents ring 11 from being lost. Also, the connection of axis 10 with ring 11 enables its rotation about axis 10. Any connection enabling this rotation may be envisioned, especially use of a circlips type of fastener.

FIGS. 3 and 9 each represent a ring 11 comprising a crown 32 in radial projection. The crown 32 has the advantage of constituting a part with larger dimensions than the serrated part of ring 11 and this advantageously facilitates gripping and manipulation during mounting of anchoring systems *6a, 6b*. Moreover, crown 32 also acts advantageously as a wear and tear preventing element and is interspersed between collar 5 and reinforcement 4, so as to prevent rubbing between these two elements, during rotation of collar 5 about its transverse axis. This crown 32 improves its functioning but is not indispensable.

Both embodiments enable the axis of collar 5 (FIGS. 5 and 6) to be inclined towards the inside or towards the outside of the foot with respect to the median vertical plane P of the foot, by an angle $\alpha$. This angle $\alpha$ is limited by the lengths la, lb of oblong grooves 8 of collar 5, this length fixing the vertical path of ring 11.

One can thus choose a large range of variation of the angle $\alpha$ by providing an oblong groove 8 with considerable length la or lb, or conversely, a small range of variation of angle $\alpha$ by providing a small length la or lb.

It is advantageous to provide for example a range of approximately 10° divided into 5° towards the outside and 5° towards the inside, corresponding to the range covered by the morphology of the users.

Moreover, one can provide oblong grooves 8 of length la and lb that are different for the external side *33b* and internal side *33a* of collar 5. One can also have a journal axis of the internal side *33a* or external side *33b* of collar 5 without an anchoring system *6a, 6b* of the type described, but only enabling rotation along a transverse axis of side *33a, 33b* of collar 5, the adjustment of the angular position of collar 5 occurring thus on a single internal or external side *33a, 33b* of collar 5, where the anchoring system *6a, 6b* is located.

On the other hand, the ratio between the number of teeth of the indentations 9 along the length la, lb of oblong groove 8 determines the precision of adjustment of the vertical position of side *33a, 33b* of collar 5. Thus, the greater this ratio, the more precise the adjustment, the positions being very close to one another and this, of course, has the advantage of enabling precise adjustment by the user.

Also, one can provide continuous variation of the position of side *33a, 33b* of collar 5, by providing an oblong groove 8 that does not have an indentation 9, in a non-represented manner, but whose vertical surfaces are smooth and enable free sliding of ring 11, whose external surfaces are also smooth. Such continuous variation may be provided either on only one of side *33a, 33b* of the collar, or on both sides simultaneously, according to the effect desired. This continuous variation is also possible in a case wherein the smooth surfaces of ring 11 are in contact with indentations 9 of the oblong groove 8, as is represented in FIGS. 7 and 8. One could also provide for the elimination of ring 11, the guiding of side 33 of collar 5 by means of its oblong groove 8 with smooth surfaces taking place directly on axis 10 affixed to reinforcement 4. The transverse maintenance of side 33 of collar 5 also takes place by means of a maintenance screw 14 or a maintenance spoiler 19.

One can also provide an embodiment as presented in FIG. 13, in which the oblong groove 8 is made in the reinforcement 4. Collar 5 includes, on each of its sides 33, an axis projecting towards the interior of the boot, and provided with a ring 11 that is pivotally mounted. This ring 11 comprises serrated surfaces 12 that cooperate with indentations 9. The means for transverse maintenance of side 33 of collar 5 on reinforcement 4 are also constituted by a maintenance screw 14 of the type represented in FIG. 3, of a maintenance spoiler 19 of the type represented in FIG. 9, the head of this screw or of this spoiler being located thus, for example, on the internal side of the boot.

The functioning of this embodiment is identical to the preceding embodiment. Moreover, this embodiment has the advantage of being constituted by a collar whose sides do not have a visible outlet opening, and this improves its aesthetic appearance.

Another embodiment, represented in FIGS. 11 and 12, provides an oblong groove 8 in side 33 of collar 5. A shoulder 35 enables indentations 9 to be hidden, so as to improve the aesthetic appearance of the collar. An oblong groove with an outlet 36 is provided in side 33 of the collar so as to enable sliding of side 33 of collar 5 on the cylindrical body 20 of screw 14, or maintenance spoiler 19.

In a non-represented manner, one can also provide an embodiment in which the oblong groove 8 is made either in collar 5, or in reinforcement 4, and is inclined with respect to the axis of collar 5 in the first case, or with respect to a right angle in the second case. The embodiment advantageously enables better adaptation of collar 5 to the morphology of the user, whose tibia inclination may exist with respect to the median longitudinal vertical plane of the foot, and also with respect to the transverse vertical plane. Another advantage, for example in this embodiment, in case of continuous variation of the position of the internal side 33 of collar 5 on reinforcement 4, in order to accentuate the internal right angular stop, is constituted by the fact that collar 5 may more closely follow the movement of the tibia with respect to the foot.

The instant application is based upon French patent application 90.10695, filed on Aug. 22, 1990, the disclosure of which is hereby expressly incorporated in its entirety by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. Sports boot for allowing a foot to rotate about an ankle, said sports boot comprising:

an upper having a heel zone, a reinforcement extending at least vertically upwardly on each side of the heel zone, and a rigid collar connected at medial and lateral sides to said reinforcement, located respectively on the medial and lateral sides of a foot, a medial and a lateral anchoring system, said medial and lateral anchoring systems each being located on a corresponding side of the foot between said upper and said collar, and enabling continuous rotation of the collar about a first axis that is substantially transverse with respect to the longitudinal axis of the upper of the boot, wherein at least one of the medial and lateral anchoring systems comprises means for varying the relative position of a corresponding side of the collar in a substantially vertical direction with respect to the reinforcement, said means for varying comprising discrete and continuous variation means including a groove having a width and being substantially vertical and formed in the side of one of the collar and reinforcement, and provided with at least one indentation on each of its vertical surfaces, a ring cooperating with said groove, the ring comprising two spaced serrated surfaces, each serrated surface having at least one tooth adapted to mesh with respective indentations of the groove, said two spaced serrated surfaces being connected to each other by two spaced smooth surfaces, said spaced smooth surfaces being spaced apart less than the width of the groove, said ring being mounted for movement about a second substantially transverse axis, whereby when said spaced smooth surfaces are located adjacent respective indentations of said groove, the ring is freely movable in said groove for free continuous vertical movement.

2. Sports boot according to claim 1, wherein the position of the side of the collar with respect to the reinforcement is variable along a direction substantially parallel to the axis of the collar.

3. Sports boot according to claim 1, wherein the position of the side of the collar with respect to the reinforcement is variable along a direction that is inclined with respect to axis of the collar.

4. Sports boot according to claim 1, wherein said groove is an oblong groove, substantially vertical and formed in the side of the collar, said ring being pivotally mounted for movement about said second substantially transverse axis and affixed to the reinforcement.

5. Sports boot according to claim 1, wherein said groove is an oblong groove that is substantially vertically provided in the reinforcement, said ring being pivotally mounted for movement about said second substantially transverse axis affixed to the side of the collar.

6. Sports boot according to claim 1, wherein said groove is an oblong groove formed in the side of the collar, and guided for movement on said ring, said ring being pivotally mounted on a substantially transverse axis affixed to the reinforcement.

7. Sports boot according to claim 1, wherein said groove is an oblong groove formed in the reinforcement and in which said ring is pivotally mounted on said second substantially transverse axis affixed to the side of the collar, and said ring being guided for movement.

8. Sports boot according to claim 1, wherein said discrete and continuous variation means change over from discrete variation to continuous variation in a reciprocal manner by disengagement of the means for varying.

9. Sports boot according to claim 8, wherein the discrete and continuous rotation means includes a transverse maintenance means for maintaining the side of the collar on the reinforcement.

10. Sports boot according to claim 9, wherein the transverse maintenance means includes an abutment of a maintenance element anchored in the reinforcement.

11. Sports boot according to claim 10, wherein the side of the collar has a thickness and the transverse maintenance means has a transverse path greater than the thickness of the side of the collar.

12. Sports boot according to claim 1, wherein the ring has a substantially square shape.

13. Sports boot according to claim 1, wherein the ring comprises two teeth that are diametrically opposed and connected by two smooth surfaces constituted by cylindrical portions.

14. Sports boot according to claim 13, wherein the smooth surfaces have a greater radius of curvature than half of the width of the groove.

15. Sports boot according to claim 1, wherein the ring is maintained transversely on the second substantially transverse axis by transverse retention means.

16. Sports boot according to claim 15, wherein the transverse retention means of the ring on said second substantially transverse axis comprises a projecting ring affixed to said second substantially transverse axis, and cooperating with a neck made in the ring, the ring comprising a chamfer acting as an engagement ramp of the ring in the neck.

17. Sports boot according to claim 1, wherein the medial and lateral anchoring systems of the reinforcement include maintenance means for connecting the collar to the reinforcement.

18. Sports boot according to claim 1, wherein the ring is provided with a crown in radial projection with respect to the ring, and interspersed between the reinforcement and the side of the collar.

19. Sports boot according to claim 4, wherein the oblong groove comprises a shoulder constituting an abutment in the transverse direction for the ring.

* * * * *